US005257891A

United States Patent [19]

Baumann et al.

[11] Patent Number: 5,257,891

[45] Date of Patent: Nov. 2, 1993

[54] BI-PLANAR CABLE CROSS REEVING SYSTEM

[75] Inventors: James A. Baumann, Orland Park; Michael A. Wisniewski, Blue Island, both of Ill.

[73] Assignee: Mi-Jack Products, Inc., Hazel Crest, Ill.

[21] Appl. No.: 954,946

[22] Filed: Sep. 30, 1992

Related U.S. Application Data

[63] Continuation of Ser. No. 657,134, Feb. 19, 1991, abandoned.

[51] Int. Cl.[5] ..... B66C 13/06

[52] U.S. Cl. ..... 414/460; 92/165 PR; 212/148; 294/81.4; 414/786; 254/285; 254/391

[58] Field of Search ..... 414/459–461, 414/560, 561, 786; 212/147, 148; 294/81.21, 81.3, 81.4; 92/165 PR; 254/284, 285, 391

[56] References Cited

U.S. PATENT DOCUMENTS

| | | | |
|---|---|---|---|
| 90,823 | 6/1869 | Cutting | 254/391 X |
| 2,646,251 | 7/1953 | Roberson | 254/391 X |
| 3,598,440 | 8/1971 | Ramsden et al. | 294/81.4 X |
| 3,653,518 | 4/1972 | Polen | 294/81.4 X |
| 3,789,998 | 2/1974 | Fathauer et al. | 294/81.4 X |
| 3,828,940 | 8/1974 | Cooper | 294/81.4 X |
| 3,899,083 | 8/1975 | Flessner et al. | 212/147 |
| 3,944,272 | 3/1976 | Fathauer | 294/81.4 X |
| 4,715,762 | 12/1987 | Lanigan, Sr. et al. | 414/460 X |
| 4,736,675 | 4/1988 | Stoll | 92/165 PR X |
| 4,953,721 | 9/1990 | Foit | 212/148 X |
| 5,018,631 | 5/1991 | Reimer | 294/81.4 X |
| 5,150,799 | 9/1992 | Long, Jr. | 212/148 X |

FOREIGN PATENT DOCUMENTS

| | | | |
|---|---|---|---|
| 2114386 | 10/1972 | Fed. Rep. of Germany | 294/81.4 |
| 4005194 | 8/1990 | Fed. Rep. of Germany | 212/148 |
| 141818 | 5/1980 | German Democratic Rep. | 212/148 |

*Primary Examiner*—David A. Bucci
*Attorney, Agent, or Firm*—Robert A. Brown

[57] ABSTRACT

A crane and lift apparatus for controlling the lifting and lowering of large cargo containers. A trolley assembly includes a hoist drum from which is suspended a system of cable or rope reevings connected to material securing assembly. The apparatus is effective to unload containers stacked one above another from one location to an alternate location. The system of cable reevings permits the raising and lowering of containers in planes defined by X, Y, and Z axes. The cables are deployed from the hoist drum on the trolley assembly to sheaves disposed at the four corners of the material securing assembly and then returned to anchor assemblies secured to an undercarriage of the trolley assembly. The sheaves are selectively angled and located in headblock assemblies positioned on the material securing assembly. A system of brakes controls movement of the cables through the sheaves. By selectively combining the angling of the sheaves with selective application of the sheave brakes, it is possible to resolve moment forces acting at each corner of a container so as to abosrb the constantly changing inertial movements that occur when the container is raised, lowered or moved horizontally. As a result, the apparatus is effective to dampen or retard the container from swaying, rolling, or pitching, from pendulous movement, and can thereby control the deployment of the container within precise vertical, horizontal, or skewed planes of orientation.

20 Claims, 12 Drawing Sheets

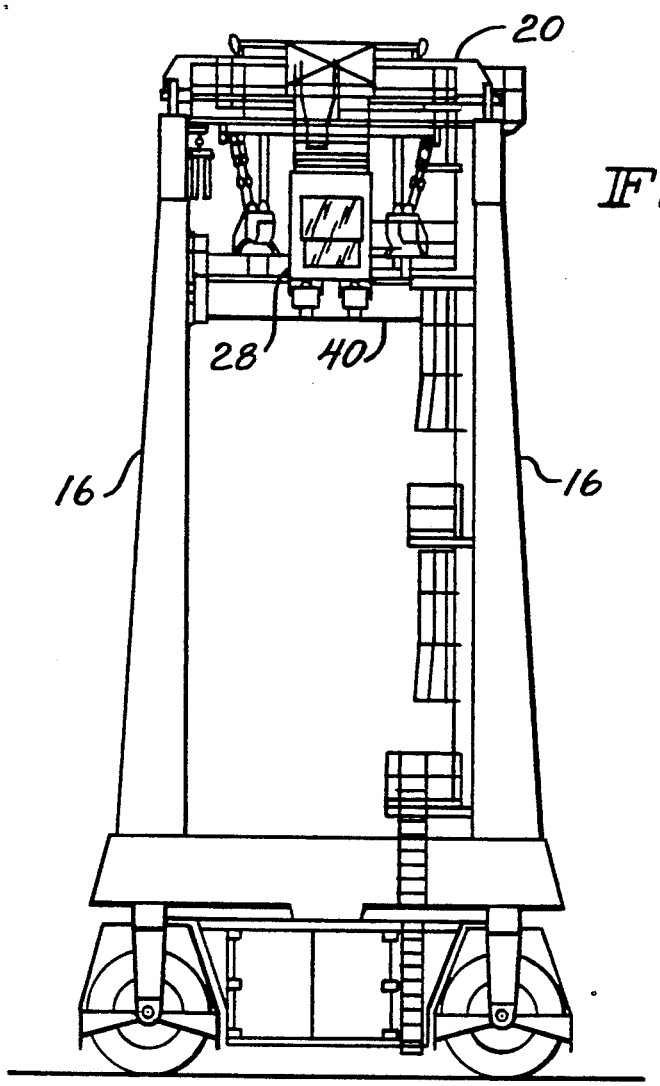
FIG. 3
FIG. 4
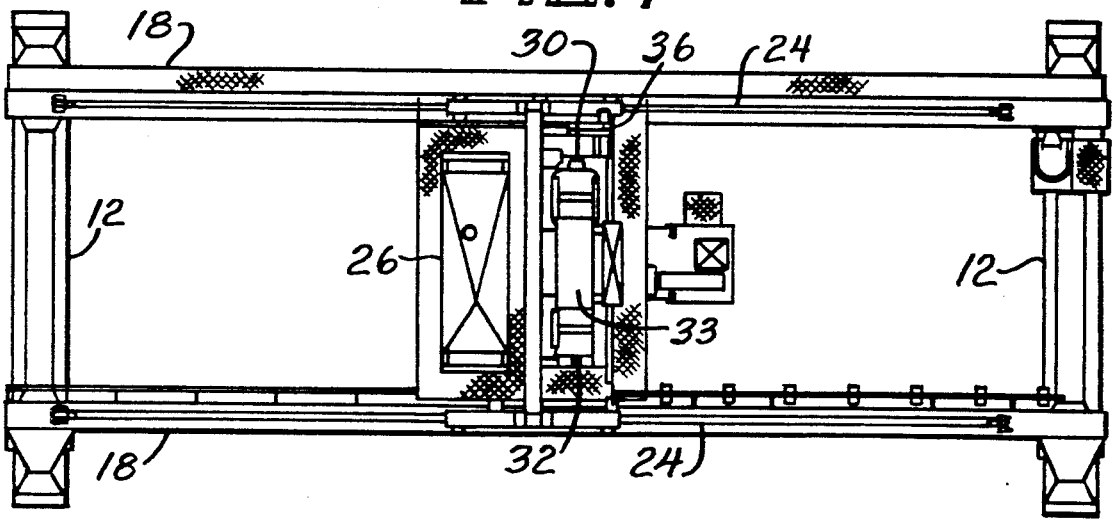

Y
X
Z
32
33
34
53
54
50
30
59
46
62
66
42
50
52
58
47
44
64
45
40

32
33
70
94
98
30
80
92
78
84
86
72
82
74
88
96
76
90
40

BI-PLANAR CABLE CROSS REEVING SYSTEM

This application is a continuation of application Ser. No. 07/657,134, filed Feb. 19, 1991, now abandoned.

BACKGROUND OF THE INVENTION

The present invention relates generally to the handling of transport containers and, more particularly, is concerned with an apparatus and method for lifting and transporting a plurality of large containers through the use of a gantry crane which includes a trolley having a bridge hoist drum from which is suspended a system of rope reevings connected to a spreader assembly.

DESCRIPTION OF THE PRIOR ART

In recent years, the use of large transport containers of several standardized forms has gained widespread use in industry. These containers permit the efficient transfer of cargo from ships to transporting vehicles, between different transporting vehicles, and to and from storage facilities. Because of the large size of the cargo containers, it has been necessary to develop equipment having the capability of effectively handling the heavy loads required for their lifting and transport. One common apparatus for lifting and transporting containers from place to place is in the form of large, self-powered gantry cranes having several separate powered functions. The crane must deliver power to drive wheels, steering mechanisms and brakes. The equipment must also be capable of moving interconnected stabilizing or bridge beams for positioning over the loads to be carried and of operating a hoist mechanism to raise and lower the containers.

In the transportation industry, specific types of transport containers have been developed for use as trailers adaptable to be connected to a truck tractor, self-contained units for loading aboard ship, or to be secured upon flat-bed railroad cars. In order to improve the efficiency of moving containers from one place to another, such as from a roadway to a railroad or a ship's hold, or any combination from or to such positions of repose, crane apparatus have been developed to straddle at least two parallel roads, tracks and the like. In addition, within the past few years, the practice of double stacking of containers has become more popular requiring from twenty-five to thirty feet of clearance between a roadway or railhead and the bottom side of a hoisting apparatus.

Accordingly, the long lengths of cable that are reeled off or returned to the hoist drum disposed on the girders are subject to swaying, swinging and the like when connected to a container or trailer holding from thirty to forty tons of dead weight materials. Further, when a container is lifted from the ground on one road or track and moves vertically in close proximity to two or more stacked containers on an adjacent road or track, the lifted container is likely to swing into the stacked containers and cause considerable damage. Thus, there is a need to provide apparatus that can prevent swaying or swinging of containers, through the entire vertical distance the containers are raised or lowered, when moved from ground level to the top of several stacked containers or at any level therebetween.

SUMMARY OF THE INVENTION

Therefore, it is a primary object of the present invention to provide a lifting apparatus that is stable during vertical movement between ground level and the uppermost horizontal beam structure of a crane.

It is a further object of the present invention to provide a lifting apparatus that includes a bi-planar cable cross reeving system that prevents pendular movement and controls raising and lowering of the containers within precisely defined vertical and/or horizontal planes.

An additional object of the present invention is to provide a lifting apparatus capable of raising and lowering containers from ground level in substantially rectilinear vertical movement.

It is still a further object of the present invention to provide a bi-planar cable cross reeving system effective to dampen movement of containers with regard to primary planes of orientation as defined by an XY vertical plane and YZ vertical plane.

Another object of the present invention is to provide a lifting apparatus having an upper bridge frame assembly movable back and forth in a horizontal direction and a lower spreader assembly with grappler arms adaptable to raise or lower trailers or containers in substantially vertical rectilinear alignment within primary vertical planes of reference.

These and other objects are achieved in accordance with the present invention wherein there is provided an improved crane and lift apparatus having hoist drum means including a cable reeving system to connect with and control a spreader assembly so that movement of containers at optimum efficiency is achieved by moving the containers from one location to another location at a different vertical level. The gantry crane apparatus includes an upper trolley power group assembly adaptable to move horizontally over a plurality of stacks of containers, a lower frame spreader assembly, or other suitable material securing means depending from and movable vertically to and from the upper trolley power group assembly, a plurality of cables having first ends secured to and rotatably disposed on hoist drum means, adaptable to rotate about a shaft supported on the trolley power group assembly, the cables extending downwardly and reeved through rotatable sheave means supported for angular orientation by headblock assemblies secured to opposite ends of the spreader assembly, the cables extending upwardly from the sheave means and being connected to dead end cylinder means secured to an undercarriage of the trolley assembly, a grapple arm assembly, magnetic holding means or other article holding means at times disposed upon the lower frame spreader assembly for securing therein a trailer, container, or the like, and power drive means for selectively moving the upper trolley assembly in a horizontal direction, and for moving the lower frame spreader assembly vertically to selective levels between ground level and the upper bridge frame assembly, whereby the trailers or containers are selectively moved from one location to another.

BRIEF DESCRIPTION OF THE DRAWINGS

The foregoing and other characteristics, objects, features and advantages of the present invention will become more apparent upon consideration of the following detailed description, having reference to the accompanying figures of the drawings, wherein:

FIG. 3 is a right side elevational view of the crane apparatus shown in FIG. 2.

FIG. 4 is a plan view of the crane apparatus shown in FIG. 2.

DESCRIPTION OF A PREFERRED EMBODIMENT

Figure 1:
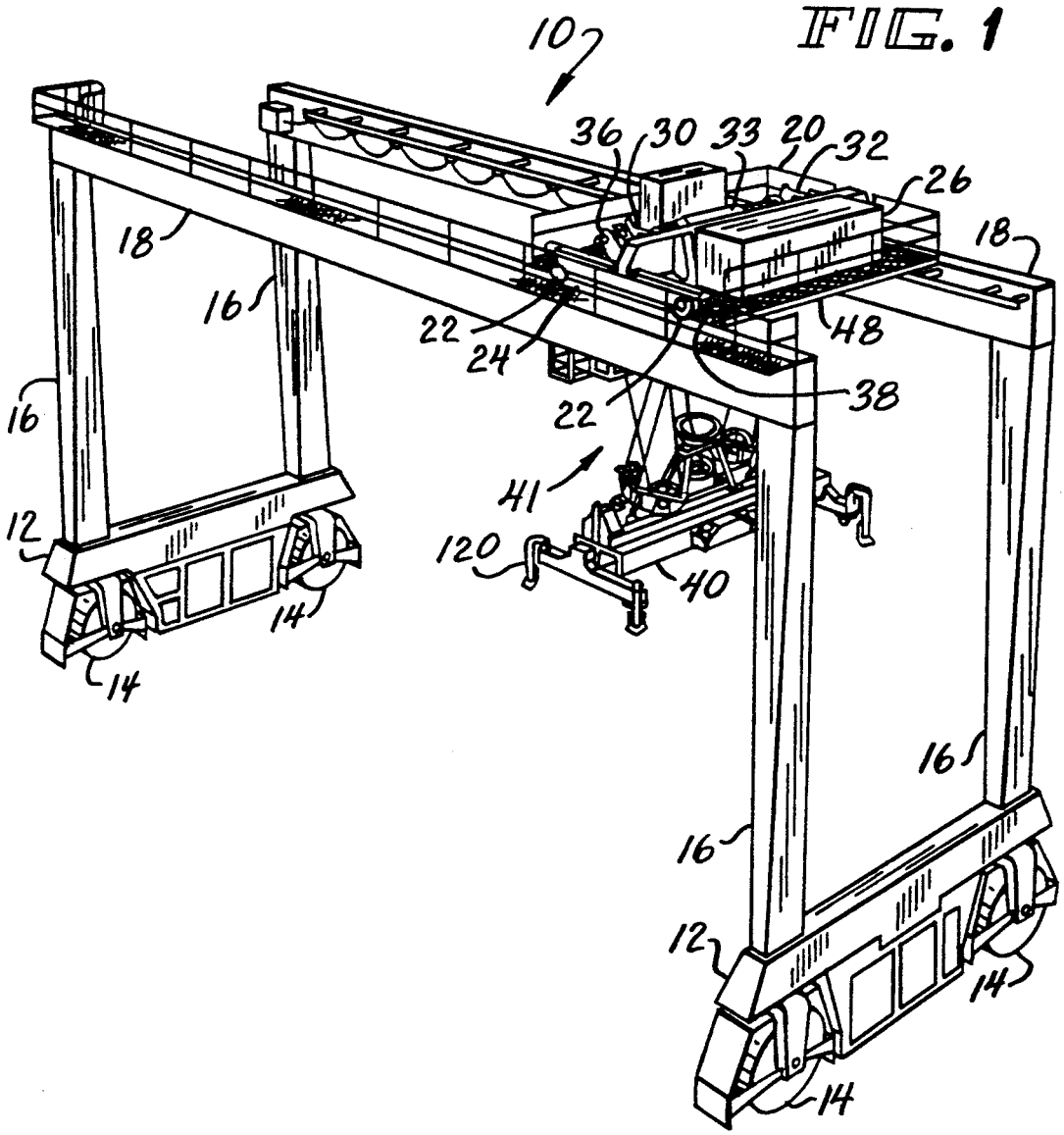
FIG. 1 is a perspective view of an overhead crane apparatus including a movable trolley assembly having a reeving system of the invention.
Figure 2:
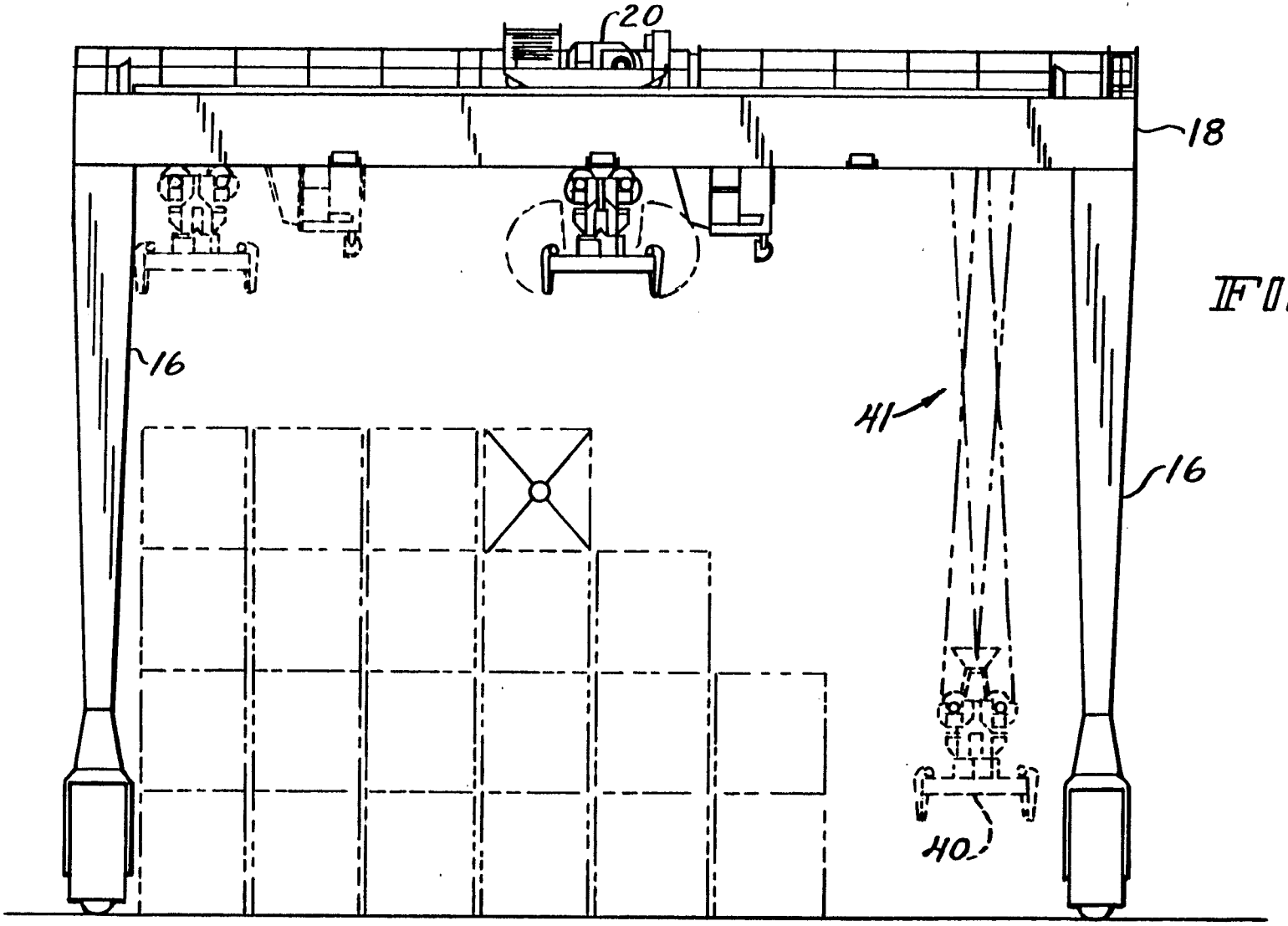
FIG. 2 is a front elevational view of the crane apparatus showing in alternate locations a spreader assembly suspended from the movable trolley assembly by the reeving system.

Referring now to FIGS. 1-5, there is shown a gantry crane and lifting apparatus, generally indicated by reference numeral 10, capable of directed movement along ground level and adaptable for lifting and transporting one or more of a stack of large containers used in roadway shipping or railroad transportation applications. The apparatus 10 includes a plurality of gantry portal assemblies constructed to include horizontal beams or girders having a number of known features. The lower portion of the gantry crane includes a pair of lower side beams 12 supported by four pivotally attached wheel assemblies 14, selectively powered by drive means for moving the crane along ground level. Two upright corner columns 16 are supportably disposed at outer ends of each lower side beam 12 and in turn support at their upper ends the respective outboard ends of two beams or girders 18. The assembly thus described is effective to move along and span a transportation container workplace, a plurality of roadways, railroad tracks, and the like.

A trolley power group assembly 20 is disposed upon and extends between the girders 18 and is adaptable to move back and forth thereacross. The trolley assembly 20 has located at each of its four corners rotatable flanged wheel means 22 fitted on railroad rails 24 or other suitable means secured to the top side of the beams or girders 18 which act to facilitate back and forth movement of the trolley from one side to the other of the gantry crane apparatus. A power package 26 controlled by an operator seated in a cab 28 causes the trolley assembly 20 to be selectively moved along the rails 24. The trolley assembly 20 includes at one side thereof a first end 30 and a second end 32 of a hoist drum means 33 adaptable for rotatable movement about longitudinal axle means 34 suitably secured in bearings affixed to a portion of the structural frame arrangement of the trolley. A drive train assembly 36 connects the hoist drum 33 to the power package 26 for selective control thereof by the operator in cab 28. A brake assembly 38 is disposed at opposite sides of the trolley assembly 20 and is effective to permit movement thereof along the rails 24 as desired and controlled by the crane operator.

Figure 5:
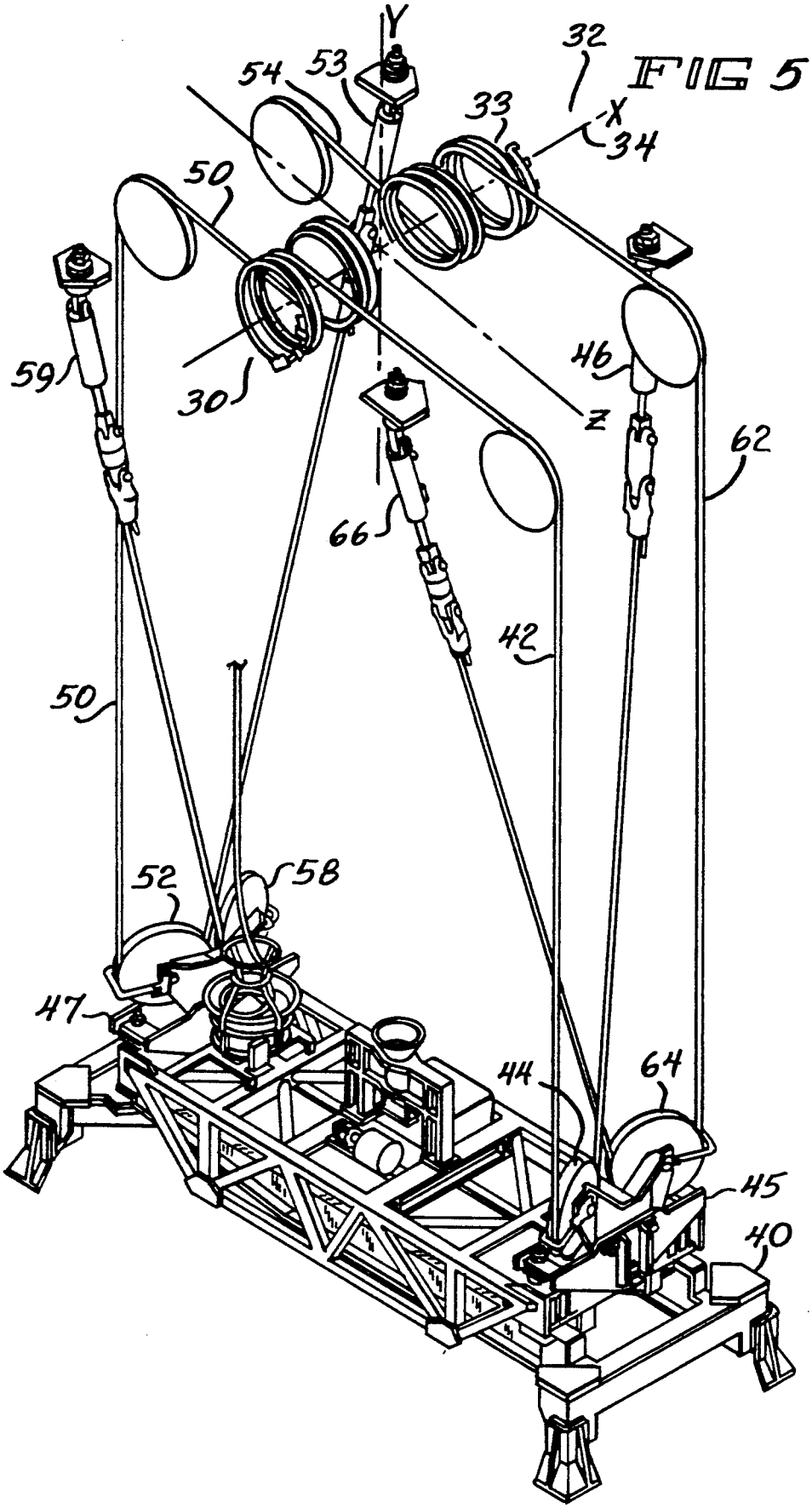
FIG. 5 is a perspective view of one embodiment of the crane apparatus reeving system of the invention.

A spreader assembly 40 is disposed below and depends from the trolley assembly 20 by means of a reeved cable system, generally identified by reference number 41, which will be hereinafter explained in detail. The first end 30 of hoist drum 33 includes a first rope or cable 42 having one end secured thereto and is wrapped therearound for a preselected number of revolutions in a clockwise orientation when observed from the left side as shown in FIG. 5. The free end of the cable 42 is directed downwardly from the drum 33 and is reeved or fed through a first sheave 44 rotatably secured in a headblock assembly 45 secured to a top side of one end of the spreader assembly 40. The cable 42 is then directed upwardly to a dead end cylinder 46 secured to an undercarriage structure 48 forming a part of the trolley assembly 20.

Similarly, a second rope or cable 50 is secured to and wrapped around the first end 30 of hoist drum 33 a preselected number of revolutions in a clockwise manner when viewed from the left side as shown in FIG. 5. The free end of cable 50 is then directed downwardly from the drum 33 and reeved or fed through a second sheave 52 rotatably secured in a headblock assembly 47 secured to the top side of the other end of the spreader assembly 40. The cable 50 is then directed upwardly to a dead end cylinder 53 secured to the undercarriage structure 48 of the trolley assembly 20.

A third rope or cable 54 is secured to and wrapped around the second end 32 of hoist drum 33 for a preselected number of revolutions in a clockwise direction as shown from the left in FIG. 5. The free end of cable 54 is then directed downwardly from the drum 33 and is reeved or fed through a third sheave 58 rotatably secured in the headblock assembly 47 secured to the top side of the other end of the spreader assembly 40. The cable 54 is then directed upwardly to a dead end cylinder 59 secured to the undercarriage structure 48 of the trolley assembly 20.

In similar fashion, a fourth rope or cable 62 is secured to and wrapped around the second end 32 of the hoist drum 33 for a preselected number of revolutions in a clockwise direction when viewed from the left in FIG. 5. The free end of cable 62 is then directed downwardly from the drum 33 and reeved or fed through a fourth sheave 64 rotatably secured in the headblock assembly 45 secured to the top side of the one end of the spreader assembly 40. The cable 62 is then directed upwardly to a dead end cylinder 66 secured to the undercarriage structure 48 of the trolley assembly 20.

Figure 6:
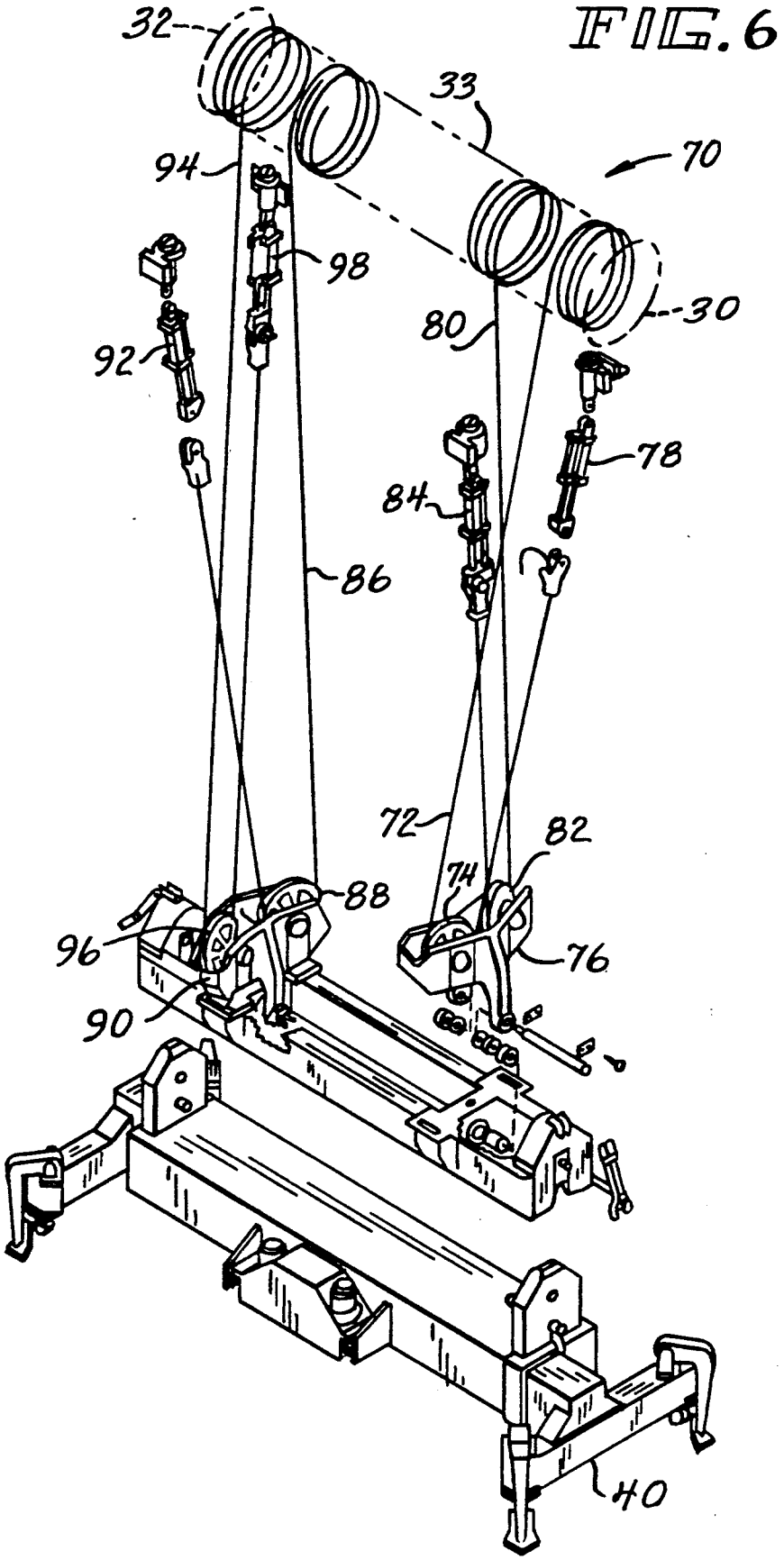
FIG. 6 is a partially assembled view of another embodiment of the crane apparatus reeving system of the invention.

Next referring to FIG. 6, the spreader assembly 40 is disposed below and depends from the trolley assembly 20 by means of a second embodiment of a reeved cable system, generally identified by reference number 70, which will be hereinafter explained in detail. The first end 30 of hoist drum 33 includes a first rope or cable 72 having one end secured thereto and is wrapped therearound for a preselected number of revolutions in a counter clockwise orientation when observed from the right side as shown in FIG. 6. The free end of the cable 72 is directed downwardly from the drum 33 and is reeved or fed through a first sheave 74 rotatably secured in a headblock assembly 76 secured to a top side of one end of the spreader assembly 40. The cable 72 is then directed upwardly to a dead end cylinder 78 secured to the undercarriage structure 48 (not shown) forming a part of the trolley assembly 20.

Similarly, a second rope or cable 80 is secured to and wrapped around the first end 30 of hoist drum 33 a preselected number of revolutions in a counter clockwise manner when viewed from the right side as shown in FIG. 6. The free end of cable 80 is then directed downwardly from the drum 33 and reeved or fed through a second sheave 82 rotatably secured in the headblock assembly 76 secured to the top side of the one end of the spreader assembly 40. The cable 80 is then directed upwardly to a dead end cylinder 84 secured to the undercarriage structure 48 of the trolley assembly 20.

A third rope or cable 86 is secured to and wrapped around the second end 32 of hoist drum 33 for a preselected number of revolutions in a counter clockwise direction as shown from the right in FIG. 6. The free end of cable 86 is then directed downwardly from the drum 33 and is reeved or fed through third sheave 88 rotatably secured in a headblock assembly 90 secured to the top side of the other end of the spreader assembly 40. The cable 86 is then directed upwardly to a dead end cylinder 92 secured to the undercarriage structure 48 of the trolley assembly 20.

In similar fashion, a fourth rope or cable 94 is secured to and wrapped around the second end 32 of the hoist drum 33 for a preselected number of revolutions in a counter clockwise direction when viewed from the right in FIG. 6. The free end of cable 94 is then directed downwardly from the drum 33 and reeved or fed through a fourth sheave 96 rotatably secured in the headblock assembly 90 secured to the top side of the other end of the spreader assembly 40. The cable 94 is then directed upwardly to a dead end cylinder 98 secured to the undercarriage structure 48 of the trolley assembly 20.

It will be noted in comparing the structure and orientation of FIGS. 5 and 6 that in FIG. 5 the horizontal axis 34 of the hoist drum 33 is parallel to the longitudinal axes of beams 18 and transverse to a longitudinal axis of the trolley assembly 20. In contradistinction, in FIG. 6, the longitudinal axis 34 of hoist drum 33 is transverse to the longitudinal axes of the girders or beams 18 and parallel to the longitudinal axis of the trolley assembly 20.

Now referring to FIGS. 7–15, there is shown in schematic form the manner in which the cables or ropes of the reeved cable system 70 depicted in FIG. 6 are utilized to provide preselected precise control of the spreader or material holding means 40. This arrangement, similar to the manner in which a puppet is manipulated by strings or wires, is effective to maintain the spreader in a neutral position whereby it is kept in a precise, non-skew alignment normal to the longitudinal axis of the girder or beams 18 of the gantry 10. In addition, the arrangement can provide up to 10 degrees rotation in either a clockwise or a counter clockwise direction about a vertical, centerline axis of the spreader.

Figure 7:
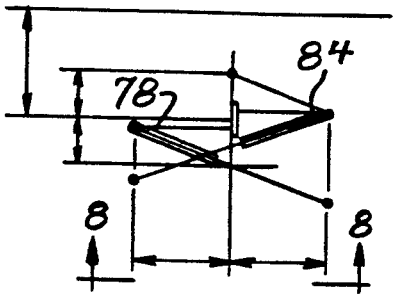
FIG. 7 is a plan view of a schematic representation of a portion of the reeving system showing a dead end cylinder arrangement wherein a container is maintained with no skew in a neutral orientation at zero degrees rotation about its vertical centerline.
Figure 9:
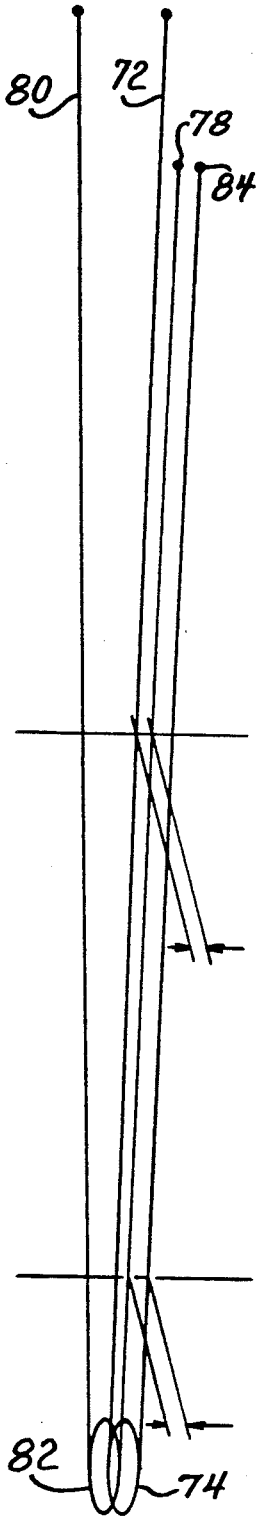
FIG. 9 is a side elevational view taken along lines 9—9 of FIG. 8 showing the deployment of reeving cables effective to maintain the spreader at zero degrees rotation and no skew.
Figure 8:
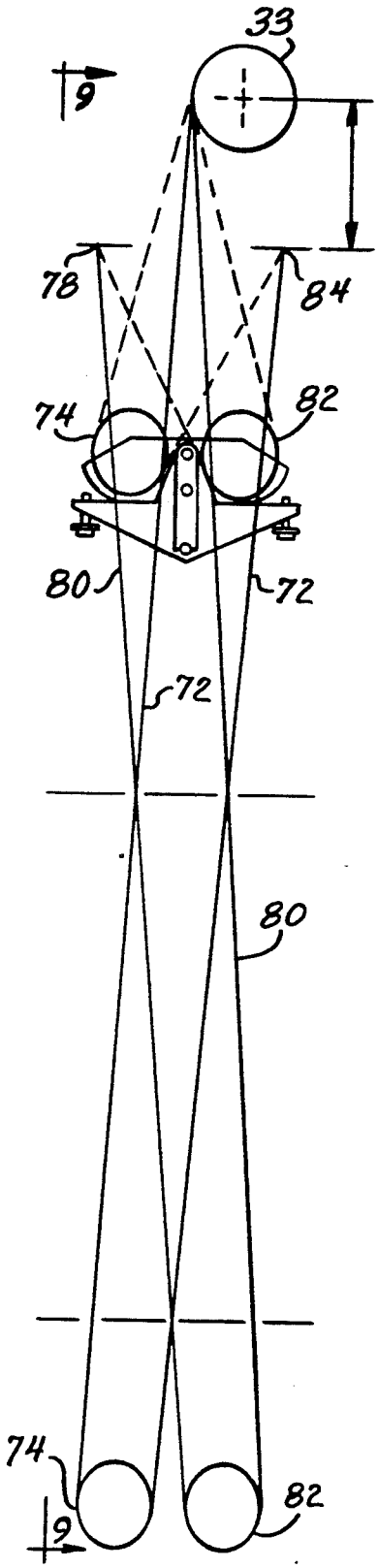
FIG. 8 is an elevational view taken along lines 8—8 of FIG. 7 showing a deployment of reeving cables effective to maintain the spreader at zero degrees rotation and no skew.
Figure 10:
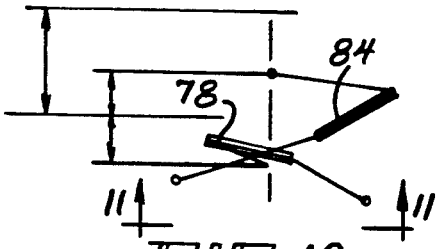
FIG. 10 is a plan view of a schematic representation of a portion of the reeving system showing the dead end cylinder arrangement when the spreader is subject to 10 degrees counter clockwise rotation.
Figure 12:
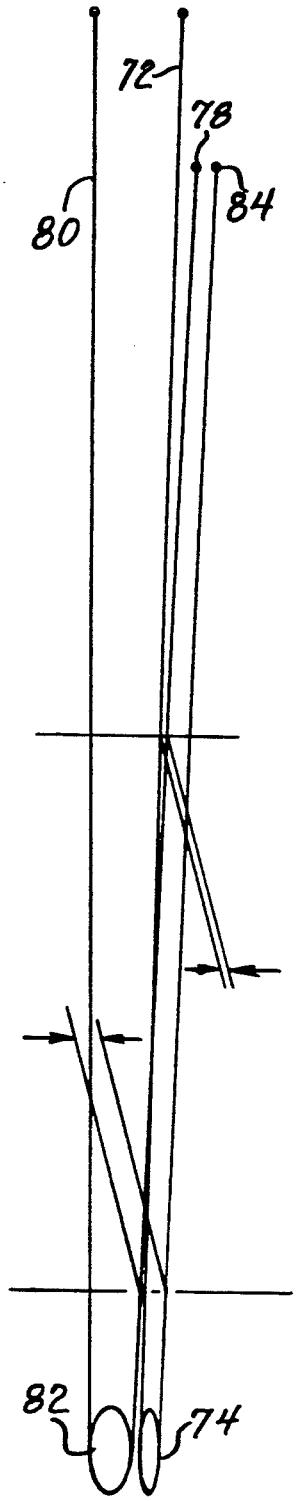
FIG. 12 is a side elevational view taken along lines 12—12 of FIG. 11 showing the deployment of reeving cables when the spreader is subject to 10 degrees counter clockwise rotation.
Figure 11:
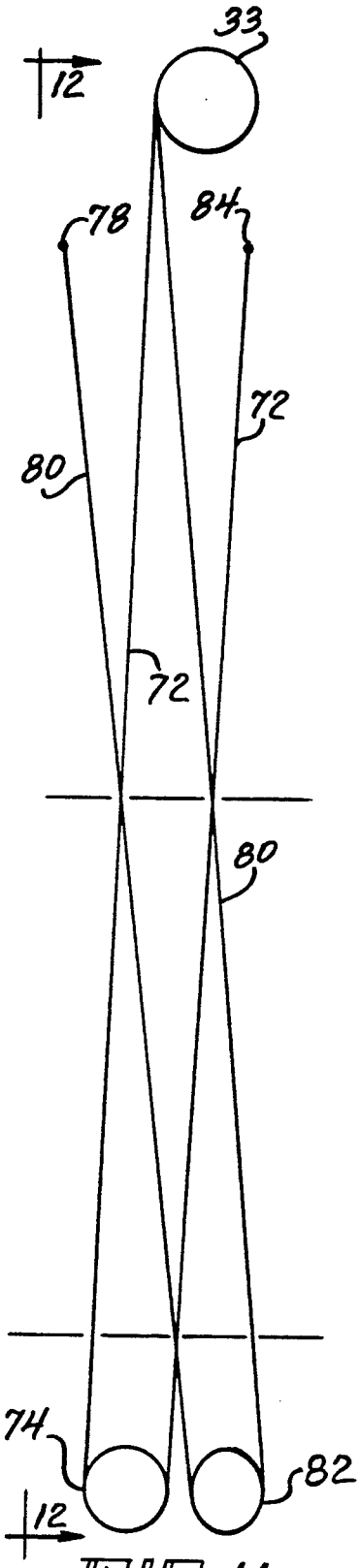
FIG. 11 is an elevational view taken along lines 11—11 of FIG. 10 showing the deployment of reeving cables when the spreader is subject to 10 degrees counter clockwise rotation.
Figure 13:
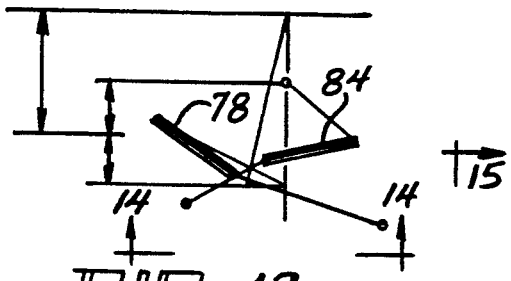
FIG. 13 is a plan view of a schematic representation of a portion of the reeving system showing the dead end cylinder arrangement when the spreader is subject to 10 degrees clockwise rotation.
Figure 15:
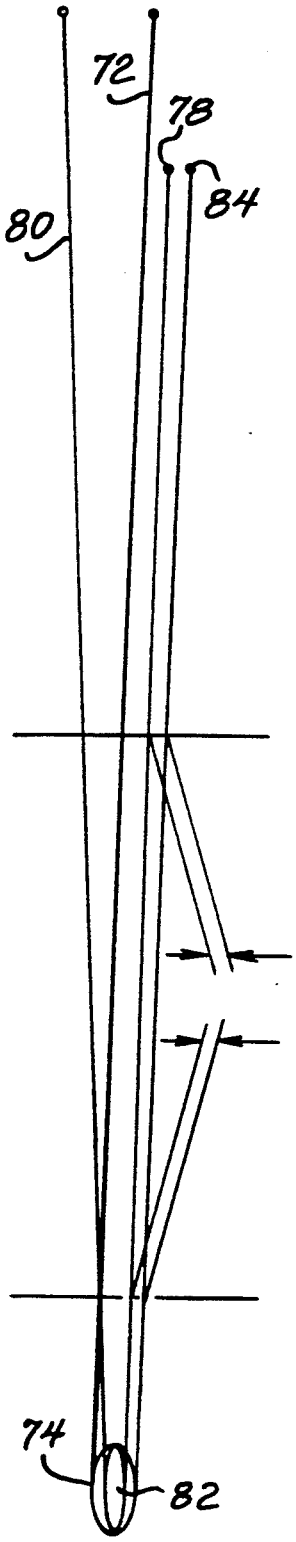
FIG. 15 is a side elevational view taken along lines 15—15 of FIG. 14 showing the deployment of reeving cables when the spreader is subject to 10 degrees clockwise rotation.
Figure 14:
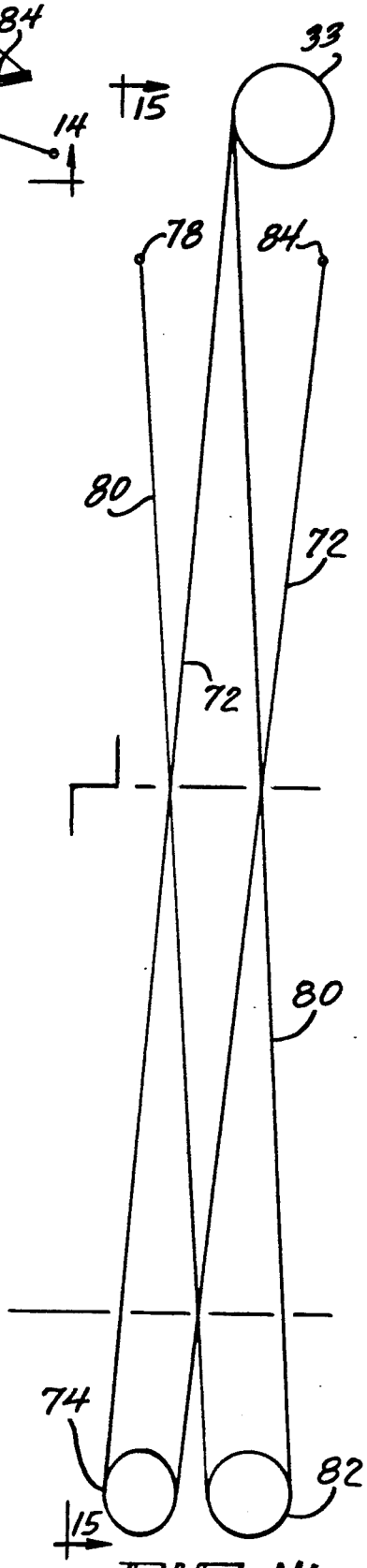
FIG. 14 is an elevational view taken along lines 14—14 of FIG. 13 showing the deployment of reeving cables when the spreader is subject to 10 degrees clockwise rotation.

In FIGS. 7–9 there is shown in schematic form a one end of the connections between the dead end cylinders and the undercarriage of the trolley. It will be understood that a similar structure is secured at the other end of the undercarriage of the trolley. Dead end cylinders 78 and 84 are adaptable to extend and retract predetermined distances either separately or in unison so as to pull in or let out the cables 72 and 80 so as to adjustably control the rotation of the spreader 40 about its vertical, centerline axis. It will be understood that the dead end cylinders 92 and 98 secured to the undercarriage 48 of the trolley 20 along with the cables 86 and 94 are adaptable to extend and retract along with cables 72 and 80 so as to maintain the spreader 40 in any desired position of orientation within the confines of the gantry crane. It will be noted the cross reeving arrangement as shown is effective to prevent swaying movement of the spreader and is accomplished without any intersection or interference of the cables between and among one another.

In similar fashion, FIGS. 10–12 and FIGS. 13–15 show structure of the cross reeving system of the invention whereby a spreader can be rotated about its vertical centerline axis a total of at least ten degrees in a counter clockwise direction and up to ten degrees in a clockwise direction about its vertical centerline axis. This ability to adjustably control the orientation of the spreader is especially advantageous where a gantry is positioned over a container for attachment thereto and it is determined the container is not positioned in precise alignment with the spreader for attachment therebetween. Accordingly, by selective operation of dead end cylinders 78, 84, 92 and 98, it is possible to position the spreader 20 over and about the container, rotate the spreader in either a counter clockwise or a clockwise direction into precise alignment with the container and obtain a secure connection therebetween.

Figure 16:
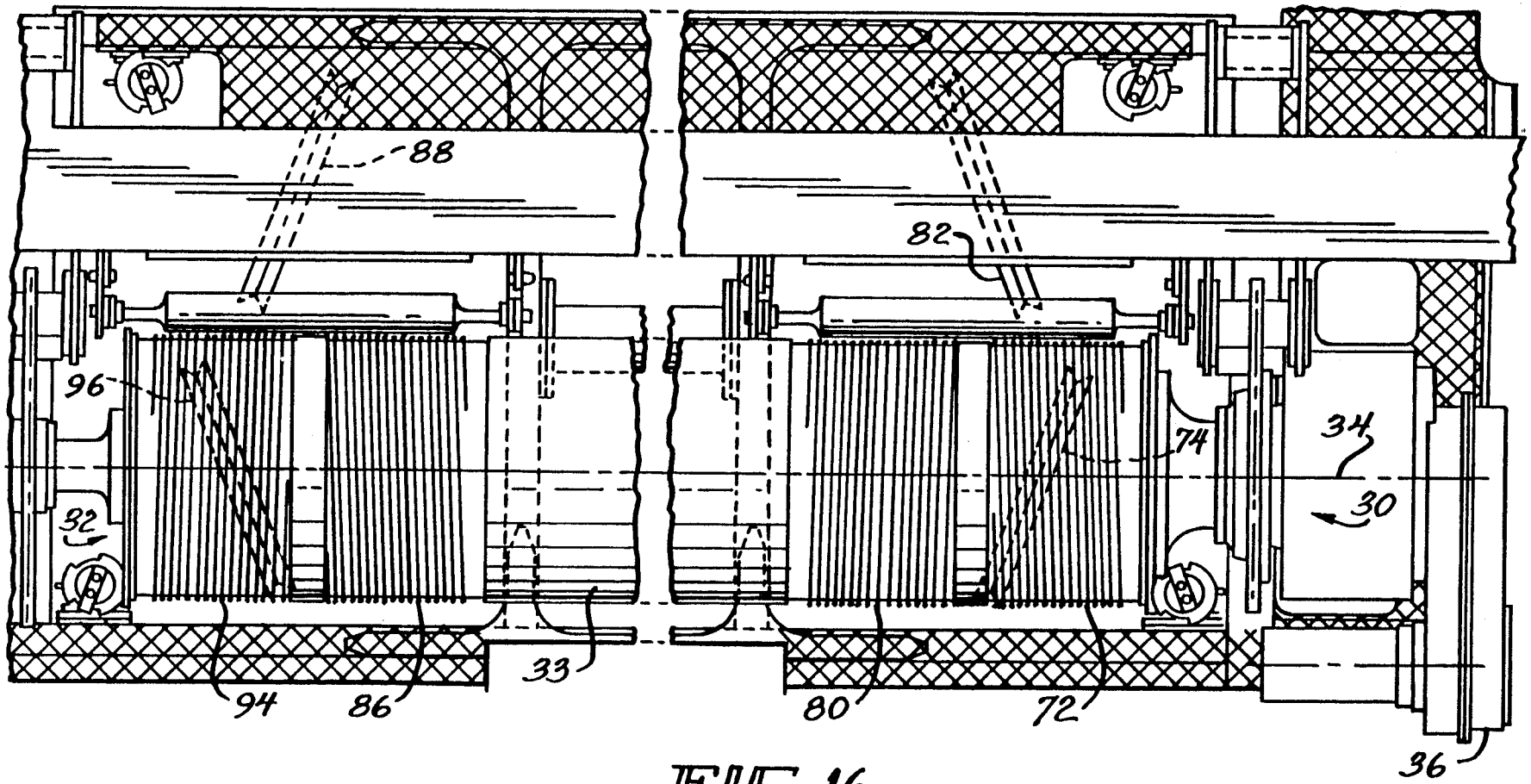
FIG. 16 is an enlarged plan view of a portion of the trolley hoist group assembly showing in phantom lines the manner in which the sheaves are angled or oriented on the spreader assembly with respect to the trolley hoist group.

Next referring to FIG. 16, a portion of the trolley group assembly 20 is shown including the hoist drum 33; the cables 72, 80, 86 and 94 wrapped therearound; and its drive train assembly 36. The cables 72, 80, 86 and 94 are respectively reeved through sheaves 74, 82, 88 and 96, each depicted in phantom lines deployed below the trolley 20 and secured to the headblock assemblies connected by fixed, swivel or other suitable means to the spreader 40. It will be noted that each sheave is mounted in its headblock assembly so that its centerline axis is maintained at an angle that is oblique to the longitudinal axis 34 of the hoist drum 33. This angled mounting position of each sheave serves to facilitate the paying out and reeling in of the individual cables in a manner that prevent intersection and interference therebetween during lowering and raising of the spreader, during the process of connecting it to a cargo container, raising and transporting the container to a preselected position within the confines of the gantry crane. Also, by manipulation of the dead end cylinders 78, 84, 92 and 98, the individual cables 72, 80, 86 and 94 can be individually controlled so as to selectively rotate and skew the position of the spreader over and about a container into close proximity thereto and thereby effect a secure connection therebetween without the need for several "passes" previously required to accomplish the desired result.

Figure 17:
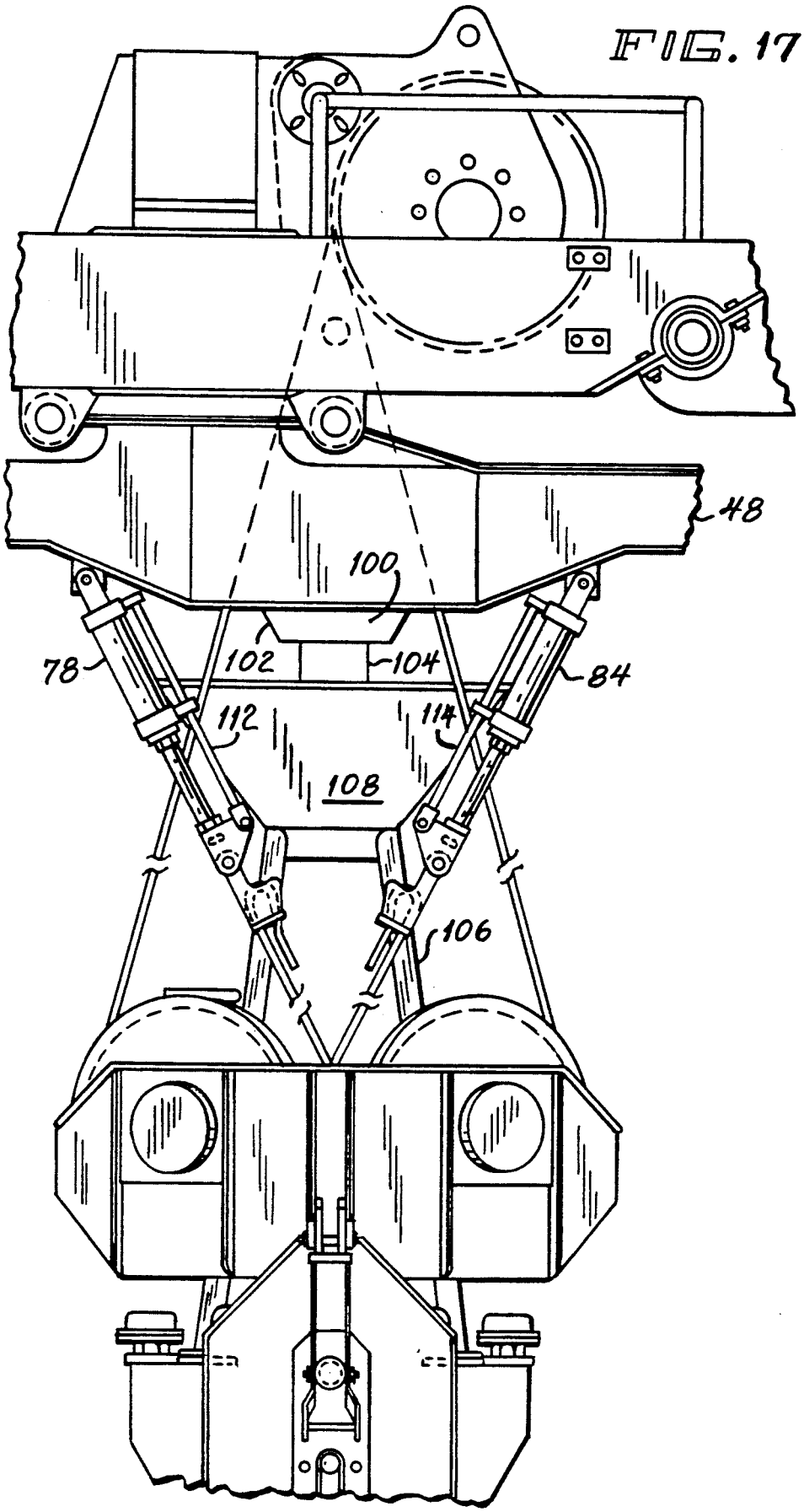
FIG. 17 is an enlarged front elevational view of the reeving system showing the manner in which ends of the cables are secure to an undercarriage of the trolley assembly by dead end cylinder having a redundant rod for resisting rotation of the cables during raising and lowering of the spreader assembly. In addition, there is partially shown an assembly comprising a guide means and a receptacle means for joining together the spreader and the trolley undercarriage so that a stable, secure connection is accomplished when the spreader is drawn upwardly and into close proximity with the undercarriage of the trolley.
Figure 18:
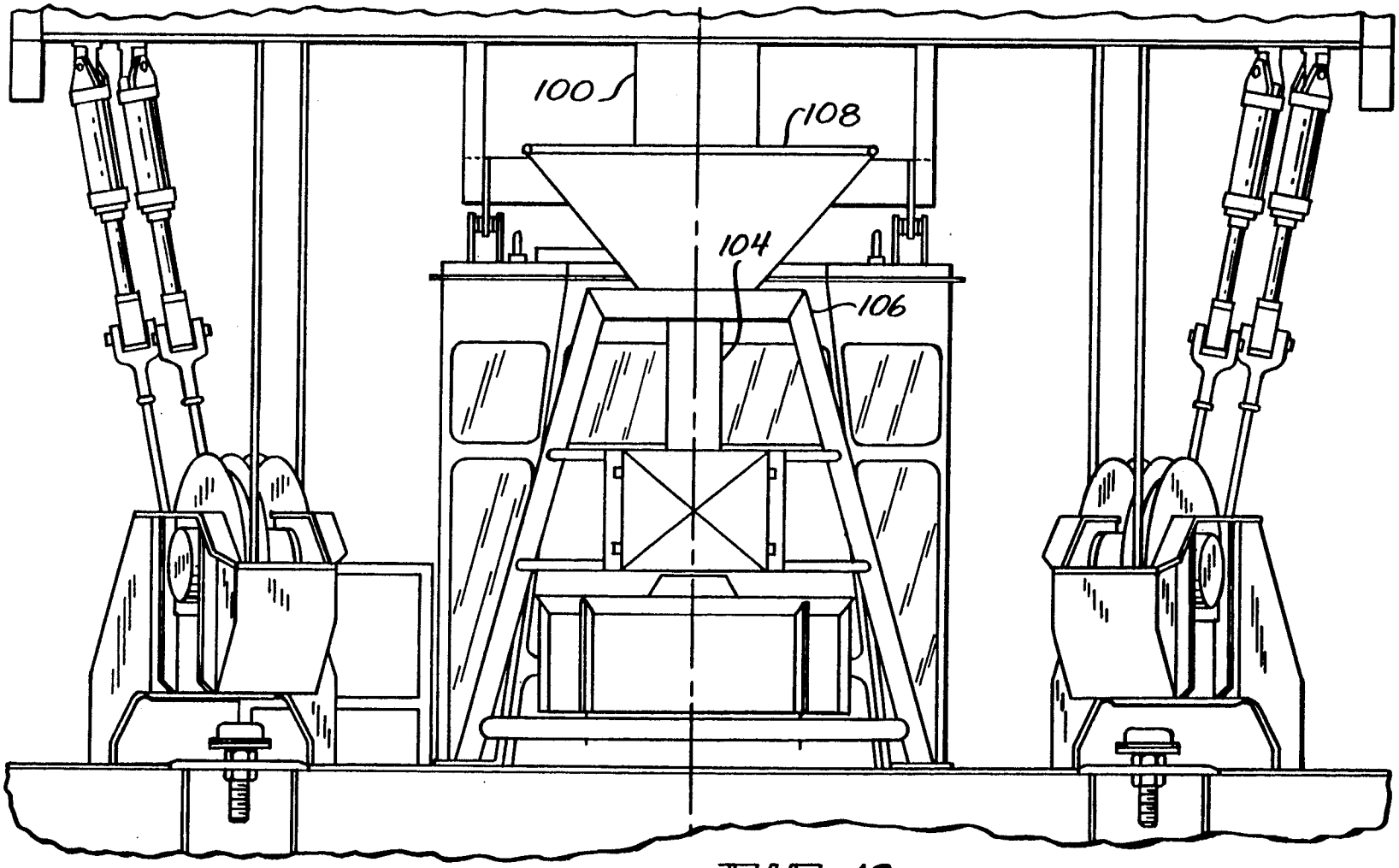
FIG. 18 is an enlarged side elevational view of the reeving system showing the manner in which ends of the cables are secured to the undercarriage of the trolley assembly by the dead end cylinders and depicting the angled orientation of the sheaves rotatably disposed in headblock assemblies of the spreader assembly. Also, the guide means and receptacle means are shown in greater detail.
Figure 19:
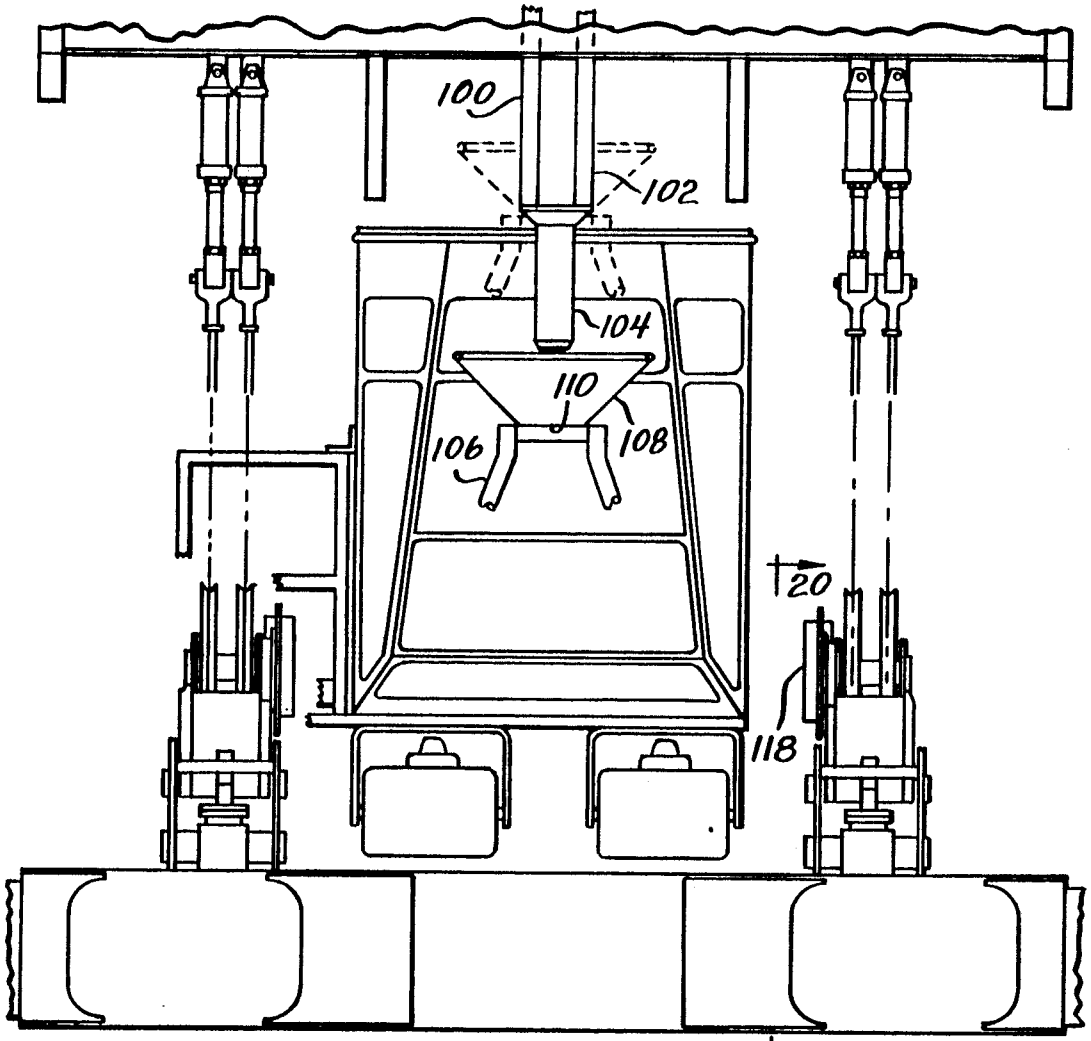
FIG. 19 is a fragmentary elevational view showing the sheaves disposed in a headblock assembly along with caliper brakes mounted thereon for permitting or preventing rotation of the sheaves. The guide means and receptacle means are shown in two positions, one being non-joined, the other being assembled.

Referring now to FIGS. 17–19, there is shown disposed a two block guide member 100 depending from and secured to the undercarriage 48 of the trolley 20. The guide member 100 preferably comprises a cylindrical upper member portion 102 and a cylindrical lower member portion 104. The diameter of upper member 102 is substantially larger than the diameter of lower member 104. A truncated base frame means 106 is connected and secured to an upper side portion of the spreader 40 and has mounted thereon a cone-shaped two block receptacle 108.

The cone-shaped receptacle 108 has provided at its lower end a cylindrical opening 110 having a diameter that is somewhat larger and adaptable to secure therein the lower member 104 of guide member 100. In addition, there may be provided a power cable (not shown) for attachment to the bottom end of the lower member 104 that drapes downwardly through the opening 110 into a cable basket (not shown) that is disposed within the base frame 106. The cable basket serves to receive and store the power cable whenever the spreader is raised upwardly toward the undercarriage of the trolley. It will be noted the power cable acts to help locate and direct the lower member 104 into the opening 110 of the receptacle 108 for positive securement therein and therebetween. It will be further noted that when the guide block member 100 and the receptacle 108 are connected, the trolley 20 and the spreader 40 are joined together in a unitary and stable relationship therebetween.

In FIG. 17 the dead end cylinders 78 and 84 are shown in greater detail and include respectively a redundant rod 112 and 114. Each redundant rod, 112 and 114, along with a respective redundant rod (not shown) for the other dead end cylinders 92 and 98, serves to provide a counter-acting moment couple to resist the torsion forces encountered in the cables as they are payed out and reeled in during lowering and raising of the spreader away from and to the trolley.

Figure 20:
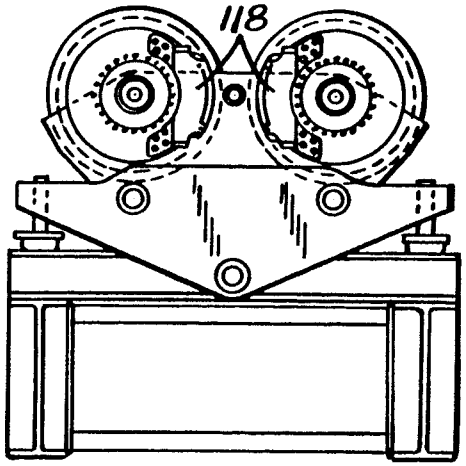
FIG. 20 is a fragmentary elevational side view taken along lines 20—20 of FIG. 19 showing the caliper brakes mounted on the shafts of the sheaves for at times preventing rotation thereof.

In FIGS. 19 and 20, a separate caliper brake 118 is mounted on the shaft of each sheave 74, 76, 88 and 96 for individual control thereof and to selectively prevent rotation of each sheave. This arrangement serves to assist an operator of the gantry to "fine tune" the spreader over and about a cargo container or other like article by selective control of rotation and skew of the spreader so as to obtain quick and easy connection between the spreader and the container.

In operation of the gantry crane apparatus of the invention, the structure may be moved along ground level to be positioned over at least one road or track, or more probably a plurality of roads or tracks on which are located one or more containers, or other working load materials, disposed singly or in stacks adjacent to each other. If the containers are stacked to a high level, the spreader assembly 40 is moved to an upper most position just below the undercarriage 48 of the trolley assembly 20. The spreader assembly 40 and the trolley assembly 20 may be locked together by virtue of the guide means 100 being received by the receptacle means 108. An attachment means in the form of corner guides 120, or other suitable means for effecting a positive connection, such as corner locks, magnetic attractors, and the like, secured to the spreader 40 are then attached to the container to be transported and the container is then lifted off the stack. The trolley assembly is then suitably moved transversely, if it is desired to move the container to an adjacent parallel location. If the movement of the container is to be toward another location that is tandemly oriented, the gantry crane is moved along the ground.

When the gantry is suitably moved to a newly selected location, assuming the container is to be positioned on ground level or a truck or railroad car near ground level, and it is necessary to lower the container in close proximity to other stacked containers, the operator is able by manipulating the paying out of cables, for example, cables 72, 80, 86 and 94 to place the container in the desired lower most position. If required, the operator can achieve precise positioning of the container by controlled operation of the dead end cylinders 78, 84, 92 and 98 to keep the container level with no roll or pitch, to rotate the container counter clockwise or clockwise within a range of ten degrees, or a total rotational movement of twenty degrees, and to obtain a desired skew by raising or lowering the four corner positions of the spreader assembly 40, which in turn controls the corner connections between the spreader and the container. Thus, it can be seen that the gantry crane is adaptable to position and adjust the container in any of a number of directional movements; namely, logitudinal, transversal, rectilineal verticalness, or in a plurality of incremental corner vertical adjustments to achieve a desired skew.

In a similar manner, when it is desired to pick up a container that is on ground level next to a stack of several containers piled on top of each other, the spreader assembly 40 is moved to a location substantially over head the ground level container. The spreader assembly 40 is then lowered to an elevation just above the container by controlled paying out of the cables secured to the spreader assembly 40 in order to minimize or avoid any interference with or crushing of containers that might occur. The spreader assembly 40 is then suitably positioned in close proximity of the container and if required is rolled, pitched, rotated and/or skewed to facilitate a connection between the attachment means and the container. In this manner, it can be readily understood that close control of attachment between the spreader assembly and the container is achieved that dampens or retards the container from swaying, swinging, and/or pendulous movement, and thereby provides a stable and efficient environment for handling working load materials.

While the present invention has been described with reference to the above preferred embodiments, it will be understood by those skilled in the art, that various changes may be made and equivalence may be substituted for elements thereof without departing from the scope of the present invention. In addition, modifications may be made to adapt a particular situation or material to the teachings of the present invention without departing from the scope of the present invention. Therefore, it is intended that the invention not be limited to the particular embodiments disclosed for carrying out this invention but that the present invention includes all embodiments falling within the scope of the appended claims.

We claim:

1. A gantry crane apparatus including a portal frame system having a pair of lower side beams supporting four corner columns in turn supporting a pair of upper girders on which are disposed generally parallel track means transverse to said lower side beams, wheel means rotatably supported beneath said frame system, drive means operatively coupled to said wheel means for causing movement of said frame system, trolley assembly means movably mounted upon said upper girders and said track means for rectilinear movement therealong, said trolley assembly means comprising;

rotatably mounted single drum hoist means for deploying therefrom a cable reeving system;

said cable reeving system cable means operatively attached to said single drum hoist means and suspended downwardly therefrom for connection to spreader assembly means;

said spreader assembly means attached to a lowermost portion of said cable means adaptable for vertical movement relative to said hoist drum means;

said cable means comprising a first cable having one end secured to said drum means, wrapped therearound and deployed downwardly therefrom for rotatable attachment to a first end of said spreader assembly means, the other end of said first cable being directed upwardly for attachment to an underside portion of said trolley assembly means;

a second cable having one end secured to said drum means, wrapped therearound and deployed downwardly therefrom for rotatable attachment to said first end of said spreader assembly means, the other end of said second cable being directed upwardly for attachment to an underside portion of said trolley assembly means;

a third cable having one end secured to said drum means, wrapped therearound and deployed downwardly therefrom for rotatable attachment to a second end of said spreader assembly means, the other end of said third cable being directed upwardly for attachment to an underside portion of said trolley means;

a fourth cable having one end secured to said drum means; wrapped therearound and deployed downwardly therefrom for rotatable attachment to said second end of said spreader assembly means, the other end of said fourth cable being directed upwardly for attachment to an underside portion of said trolley means;

joined coupling means disposed between said other end of each of said four cables and dead end cylinder means disposed on said underside portion of said trolley means for selectively extending and retracting so as to adjust incremental lengths of each of said cables;

attachment means secured to said spreader assembly means for connecting to, carrying and releasing one or more working loads; and power drive means operatively coupled to said drive means, said trolley assembly means and said hoist drum means, said power drive means acting selectively to operate said drive means to cause movement of said portal frame system, said trolley assembly means along said upper girders, and to rotate said drum hoist means for lifting and lowering said one or more working loads;

whereby said power drive means is effective to selectively and incrementally adjust each of said cables so as to control roll, pitch, and skew of said one or more working loads about its centerline axis.

2. The gantry crane apparatus of claim 1 comprising operator control means separately connected to said drive means, said trolley assembly means, said hoist drum means and said attachment means for independently regulating the respective operative movement thereof.

3. The gantry crane apparatus of claim 1 wherein said spreader assembly means comprises sheave means secured to its opposite ends for receiving said cable means in rotatable frictional movement therethrough.

4. The gantry crane apparatus of claim 1 wherein said spreader assembly means comprises headblock assembly means disposed at its opposite ends for receiving said cable means in rotatable frictional movement therethrough.

5. The gantry crane apparatus of claim 3 comprising brake means mounted on said sheave means for at times preventing movement of said cable means through said sheave means.

6. The gantry crane apparatus of claim 3 wherein said sheave means are adaptable to be selectively positioned at predetermined angles of orientation with respect to a longitudinal axis of said hoist drum means.

7. The gantry crane apparatus of claim 1 wherein said hoist drum means has a longitudinal axis normal to longitudinal axes of said upper girder means.

8. The gantry crane apparatus of claim 1 wherein said hoist drum means has a longitudinal axis parallel to longitudinal axes of said upper girder means.

9. The gantry crane apparatus of claim 1 wherein said trolley assembly means comprises undercarriage means disposed below and movable as a unit therewith.

10. The gantry crane apparatus of claim 9 wherein each said dead end cylinder means comprises redundant rod means for forming a reactive moment couple to resist twisting torsion forces in each of said cables.

11. The gantry crane apparatus of claim 1 wherein said trolley assembly means comprises undercarriage means disposed below for movement as a unit therewith, a guide member disposed within said undercarriage means and extending downwardly therefrom, and receptacle means disposed at an upper side of said spreader assembly means for at times receiving said guide member in locking engagement therewith.

12. The gantry crane apparatus of claim 1 wherein said cable means at times rotates the spreader assembly means at least ten degrees in a clockwise direction.

13. The gantry crane apparatus of claim 1 wherein said cable means at times rotates the spreader assembly means at least ten degrees in a counter clockwise direction.

14. A bi-planar cross reeving apparatus including trolley assembly means movably mounted on a gantry crane apparatus for rectilinear movement therealong, and power drive means operatively coupled to said trolley means and said gantry crane apparatus, said power drive means acting selectively to cause movement of said gantry crane apparatus and said trolley assembly means, comprising single drum hoist means supported at an upperside portion of said trolley means for deploying therefrom four cable means, said four cable means having respective first ends secured to said single drum hoist means, wrapped selectively therearound, for downward deployment therefrom;

material securing means disposed below said single drum hoist means for at times attaching to a working load;

head block assembly means disposed at opposite ends of said material securing means for respectively receiving two rotatable sheaves;

each of said rotatable sheaves being angled obliquely to a longitudinal axis of said material securing means;

each of said four cable means being reeves through a respective sheave in rotatable frictional engagement therewith and thereafter directed upwardly to be individually secured at an underside portion of said trolley assembly means;

adjustable anchor means disposed at said underside portion of said trolley assembly means for individually receiving and securing a jointed coupling which individually receives and secures respective second ends of each of said four cables; and brake means operably attached to each of said sheaves for at times stopping individual rotation thereof;

said single drum hoist means being effective to payout and reel in said cable means to lower and raise said material securing means between a ground level and a preselected level of elevation;

whereby selective operation of said adjustable jointed anchor and coupling means in cooperation with selective braking of said sheave means are effective to incrementally control roll, pitch, and skew of said material securing means about its centerline axis at any position thereof between said ground level and said preselected level of elevation.

15. The cross reeving system of claim 14 including adjusting means for controlling said selective operation of said anchor means and said brake means to rotate said material securing means within a range of twenty degrees.

16. The cross reeving system of claim 14 wherein said four cable means at times rotates the material securing means at least ten degrees in a clockwise direction.

17. The cross reeving system of claim 14 wherein said four cable means at times rotates the material securing means at least ten degrees in a counter clockwise direction.

18. The cross reeving system of claim 14 wherein said adjustable anchor means comprises dead end cylinder means for resisting torque in said four cable means.

19. The cross reeving system of claim 18 wherein said dead end cylinder means comprises redundant rod means for resisting torque in said four cable means.

20. A method of controlling vertical, horizontal and skew movement of working load material, raised and lowered by a gantry crane apparatus, comprising the steps of providing a portal frame system having a pair of lower side beams supporting four corner columns in turn supporting a pair of upper girders forming generally parallel tracks transverse to said lower side beams, providing wheel means rotatably supported beneath said portal frame system, drive means operatively coupled to said wheel means for causing movement of said portal frame system, providing trolley assembly means supported by said upper girders for horizontal movement therealong, providing spreader assembly means having securing means for attachment to said working load material, providing a single drum hoist means rotatably supported on said trolley assembly means for deploying therefrom a cable reeving system;

providing a cable means secured to and depending from said single drum hoist means for connecting to said spreader assembly means and operable to raise, lower, or skew the spreader assembly means in preselected directional increments, deploying a first cable of said cable means downwardly for rotatable attachment to a first end of said spreader assembly means and upwardly for attachment to an underside portion of said trolley assembly means, deploying a second cable of said cable means downwardly for rotatable attachment to said first end of said spreader assembly means and upwardly for attachment to an underside portion of said trolley means, deploying a third cable of said cable means downwardly for rotatable attachment to a second end of said spreader assembly means and upwardly for attachment to an underside portion of said trolley assembly means, deploying a fourth cable of said cable means downwardly for rotatable attachment to said second end of said spreader assembly means and upwardly for attachment to an underside portion of said trolley means, providing individual jointed coupling means disposed between said individual adjustable anchor means disposed on said underside portion of said trolley means and each of said four cables to form a counter-acting moment couple for resisting torque in each of said four cables, moving said trolley assembly means to a position substantially overhead said working load material, lowering said spreader assembly means to an elevation substantially adjacent said working load material, rotating and/or skewing said spreader assembly means into position for attachment to said working load material, selectively and incrementally adjusting each of said cables to a position of controlled roll, pitch and skew about said working load material, securing said spreader assembly means to said working load material, and removing said working load material from a first to an alternate location.

* * * * *